US006133697A

United States Patent [19]

Nagai et al.

[11] Patent Number: 6,133,697

[45] Date of Patent: Oct. 17, 2000

[54] DIMMING APPARATUS FOR FLUORESCENT LAMPS

[75] Inventors: Satoshi Nagai; Kenichiro Nishi; Takahisa Hamaguchi; Kentaro Eguchi; Jun Bunya, all of Tokyo; Osamu Ishikawa, Kanagawa, all of Japan

[73] Assignees: Mitsubishi Denki Kabushiki Kaisha, Tokyo; Mitsubishi Lighting Fixture Co., Ltd., Kamakura, both of Japan

[21] Appl. No.: 09/381,690

[22] PCT Filed: May 11, 1998

[86] PCT No.: PCT/JP98/02073

§ 371 Date: Sep. 23, 1999

§ 102(e) Date: Sep. 23, 1999

[87] PCT Pub. No.: WO99/59383

PCT Pub. Date: Nov. 18, 1999

[51] Int. Cl.[7] ..... G05F 1/00

[52] U.S. Cl. ..... 315/307; 315/291; 315/224; 315/DIG. 4

[58] Field of Search ..... 315/307, 291, 315/224, 225, 308, 247, DIG. 4, DIG. 5

[56] References Cited

U.S. PATENT DOCUMENTS

| | | | |
|---|---|---|---|
| 5,696,431 | 12/1997 | Giannopoulos et al. | 315/308 |
| 5,872,429 | 2/1999 | Xia et al. | 315/291 |
| 6,011,357 | 1/2000 | Gradzki et al. | 315/224 |

FOREIGN PATENT DOCUMENTS

| | | |
|---|---|---|
| 63-245899 | 10/1988 | Japan . |
| 5-135894 | 6/1993 | Japan . |
| 5-283189 | 10/1993 | Japan . |
| 6-251890 | 9/1994 | Japan . |
| 6-267687 | 9/1994 | Japan . |

*Primary Examiner*—Don Wong
*Assistant Examiner*—Wilson Lee
*Attorney, Agent, or Firm*—Burns, Doane, Swecker & Mathis, LLP

[57] ABSTRACT

The present invention is to provide a fluorescent lamp dimming apparatus capable of continuously dimming the fluorescent lamp, and capable of eliminating a fluctuation of light outputs, and in particular, capable of turning ON the fluorescent lamp in a low temperature. The fluorescent lamp dimming apparatus is comprised of a lamp voltage detecting circuit for detecting a discharge voltage of the fluorescent lamp, and a control unit intermittently controls the output frequency of a high frequency power supply in such a manner that the output frequency becomes higher than a dimming frequency based on the dimming signal so as to periodically change a current supplied to the fluorescent lamp into a low current; and when the output frequency of the high frequency power supply becomes higher than the dimming frequency, the control unit sets a lower limit dimming set value based upon a detection voltage of the lamp voltage detecting circuit in order that the output frequency of the high frequency power supply is controlled to become lower than, or equal to the upper limit frequency in accordance with the lower limit dimming set value.

11 Claims, 12 Drawing Sheets

DIMMING APPARATUS FOR FLUORESCENT LAMPS

TECHNICAL FIELD

The present invention relates to a dimming apparatus of a fluorescent lamp, and more specifically, to a technique for turning ON the fluorescent lamp under stable condition in a low temperature.

BACKGROUND ART

FIG. 23 is a block diagram for representing an arrangement of a conventional dimming (light controlling) apparatus of a fluorescent lamp, similar to the fluorescent lamp dimming apparatus described in, for example, Japanese Patent Application Laid-Open No. Hei 6-333692.

In FIG. 23, reference numeral 1 indicates a high frequency power supply, reference numeral 2 indicates a coil, reference numeral 3 shows a fluorescent lamp (will be simply referred to as a lamp hereinafter), reference numeral 4 denotes a control unit of the high frequency power supply 1, and reference numeral 5 represents a dimming (light controlling) signal.

In the apparatus shown in FIG. 23, the control unit 4 controls the frequency of the high frequency power supply 1 in response to the dimming signal 5 entered thereinto. Since the high frequency power supply 1 is connected via the coil 2 to the lamp 3, the impedance of the coil 2 is varied by the frequency of the high frequency power supply 1. In connection with this impedance change, a high frequency current flowing through the lamp 3 is varied. In other words, the higher the frequency of the high frequency power supply 1 becomes, the smaller the current flowing through the lamp 3 becomes, so that the lamp 3 is brought into dimming states.

Since the dimming degree of the lamp 3 is substantially directly in proportion to the current flowing through the lamp 3, the control unit 4 controls the frequency of the high frequency power supply 1 in response to the inputted dimming signal 5 so as to dim the lamp 3. For the sake of convenience, in the case that the dimming signal 5 indicates a specific dimming degree, a frequency outputted from the high frequency power supply 1 is referred to as a dimming frequency, and also, a dimming degree at this time is referred to as a set dimming degree (% indication).

FIG. 24 is a graphic representation for showing an example of the output frequency of the high frequency power supply 1 with respect to the set dimming degree. The control unit 4 controls the high frequency power supply 1 in such a way that when the set dimming degree is equal to, for example, 100%, the frequency becomes 50 kHz, whereas when the set dimming degree is equal to 25%, the frequency becomes 80 kHz.

The light output from the lamp 3 under this control condition is indicated in a graphic representation of FIG. 25. In FIG. 25, 0° C., 10° C., and 25° C. represent atmospheric temperatures of the lamp 3. Even under the same set dimming degree, the light outputs are different from each other, depending upon the lamp atmospheres. This may be caused by the characteristics of the lamp 3, namely the lamp impedance of the lamp 3 owns the temperature characteristic. For instance, when the set dimming degree is equal to 100%, the light output becomes L1 at 25° C.; the light output becomes L2 at 10° C.; the light output becomes L3 at 0° C., and thus, a relationship of L1>L2>L3 is established.

Also, in such a case that the atmospheric temperature of the lamp 3 is 25° C., the light output is continuously changed with respect to the set dimming degree. To the contrary, when the atmospheric temperatures of the lamp 3 are equal to 10° C. and 0° C., if the set dimming degree is decreased, then the light outputs are rapidly changed, so that discontinuous points appear.

As apparent from the above graphic representation, when the atmospheric temperature of the lamp 3 is 0° C., the light output is changed from a point A to a point B in the vicinity of the set dimming degree of 40% (between 35% and 45%), and the light output becomes very small at the point B. Also, when the atmospheric temperature of the lamp 3 is 10° C., a similar phenomenon occurs in the vicinity of the set dimming degree of 30%.

This reason is given as follows. When the atmospheric temperature of the lamp 3 is low (less than or equal to 10° C.), the lamp voltage is increased in the dimming degree lower than, or equal to a certain dimming degree, as compared with that of the normal temperature. Also, the lower the dimming degree becomes, the stronger the increasing trend of the lamp voltage is changed. When the lamp voltage is rapidly increased, the operating point of the current flowing from the high frequency power supply 1 to the coil 2 and the lamp 3 becomes unstable. The lamp current is suddenly decreased by feeding such a loop that the current flowing through the lamp 3 is decreased→the impedance of the lamp 3 is increase→the current flowing through the lamp 3 is decreased.

At this time, there are some possibilities that the light output is fluctuated, depending upon the condition of the lamp 3. Since the lamp voltage is low in the normal temperature (25° C.), the operating point becomes one, and the lamp current may flow under stable condition by the coil 2.

Since the above-described conventional fluorescent lamp dimming apparatus is arranged in the above-described manner, when the lamp peripheral temperature is low, the light output is rapidly lowered, depending upon both the temperature characteristics of the lamp 3 and the circuit condition from the high frequency power supply 1. As a result, there are such problems that the lamp cannot be dimmed in the continuous manner, and also the light output is fluctuated.

The present invention has been made to solve these problems, and has an object to provide a fluorescent lamp dimming apparatus capable of continuously dimming the fluorescent lamp, and also capable of eliminating fluctuations of light outputs.

DISCLOSURE OF THE INVENTION

A dimming apparatus of a fluorescent lamp, according to the present invention, is characterized by comprising: a fluorescent lamp; a high frequency power supply for supplying high frequency power to the fluorescent lamp; a control unit for controlling an output frequency of the high frequency power supply in response to an inputted light dimming signal; and a coil provided between the high frequency power supply and the fluorescent lamp, for limiting a current which flows from the high frequency power supply to the fluorescent lamp; wherein: the dimming apparatus is further comprised of a lamp voltage detecting circuit for detecting a discharge voltage of the fluorescent lamp; and the control unit intermittently controls the output frequency of the high frequency power supply in such a manner that the output frequency becomes higher than a dimming frequency based on the dimming signal so as to periodically change a current supplied to the fluorescent lamp into a low current;

and when the output frequency of the high frequency power supply becomes higher than the dimming frequency, the control unit sets a lower limit dimming set value based upon a detection voltage of the lamp voltage detecting circuit in order that the output frequency of the high frequency power supply is controlled to become lower than, or equal to the upper limit frequency in accordance with the lower limit dimming set value.

Also, the above-described control unit is characterized in that when a set dimming degree based upon the inputted dimming signal is smaller than, or equal to a predetermined dimming degree, the control unit intermittently controls the output frequency of the high frequency power supply in such a manner that the output frequency becomes a test frequency higher than the dimming frequency from the dimming frequency based upon the dimming signal.

Also, the above-described control unit is characterized in that when the detection voltage of the lamp voltage detecting circuit is higher than a preset threshold value voltage, the control unit sets a lower limit dimming value; and when the set dimming degree based on the dimming signal is smaller than the lower limit dimming value, while the control unit sets the output frequency of the high frequency power supply to a frequency higher than the dimming frequency, the control unit varies the output frequency from the test frequency to an upper limit frequency in response to the lower limit dimming value.

Also, the above-described control unit is characterized in that in the case that a difference voltage is higher than, or equal to a preset threshold value voltage, the difference voltage being produced between a detection voltage by the lamp voltage detecting circuit when a dimming frequency is outputted and another detection voltage by the lamp voltage detecting circuit when a test frequency higher than the dimming frequency is outputted, the control unit sets a lower limit dimming value; and in the case that the set dimming degree based upon the dimming signal is smaller than the lower limit dimming value, the control unit sets the output frequency of the high frequency power supply to an upper limit frequency in response to the lower limit dimming value.

Also, the above-described control unit is characterized in that in the case that the difference voltage is higher than, or equal to the preset threshold value voltage, the difference voltage being produced between the detection voltage by the lamp voltage detecting circuit when the dimming frequency is outputted and another detection voltage by the lamp voltage detecting circuit when the test frequency higher than the dimming frequency is outputted, the control unit controls the output frequency of the high frequency power supply to become the dimming frequency.

Also, the above-described control unit is characterized in that in the case that the difference voltage is higher than, or equal to the preset threshold value voltage, the difference voltage being produced between the detection voltage by the lamp voltage detecting circuit when the dimming frequency is outputted and another detection voltage by the lamp voltage detecting circuit when the test frequency higher than the dimming frequency is outputted, the control unit controls the output frequency of the high frequency power supply to be returned to the dimming frequency after controlling the output frequency for a predetermined time period in such a manner that the output frequency becomes a current increase frequency lower than the dimming frequency.

Also, the above-described control unit is characterized in that the control unit sets the lower limit dimming set value of the fluorescent lamp within a range from 5% to 60% with respect to a dimming degree when the rated power is entered to the fluorescent lamp in the normal temperature.

Also, the above-described control unit is characterized in that the control unit varies the lower limit dimming set value in response to the detection voltage of the lamp voltage detecting circuit.

Also, the above-described control unit is characterized in that the control unit sets a relationship between a time period T0 and a dimming frequency f1 to $T0 \geqq 3/f1$, in which a frequency is intermittently varied in the time period T0.

Also, the above-described control unit is characterized in that the control unit sets time T0 during which a frequency is intermittently varied to $T0 \geqq 0.1$ ms.

Furthermore, the above-described control unit is characterized in that the control unit sets both time T0 during which a frequency is intermittently varied and time T2 during which a frequency higher than the dimming frequency is outputted to $T2 \leqq T0/2$.

BEST MODE FOR CARRYING OUT THE INVENTION

Embodiment Mode 1.

Figure 1:
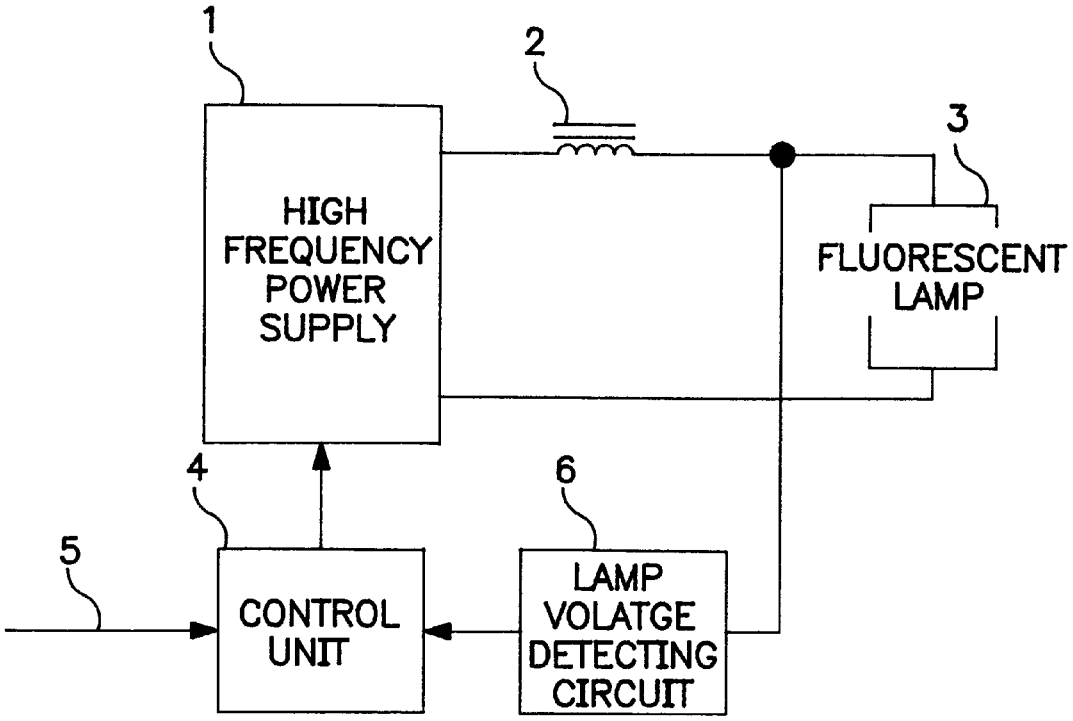
FIG. 1 is a block diagram for indicating an arrangement of a dimming apparatus for a fluorescent lamp according to an embodiment mode 1 of the present invention.

FIG. 1 is a block diagram for representing a dimming apparatus of a fluorescent lamp, according to an embodiment mode 1 of the present invention.

Figure 23:
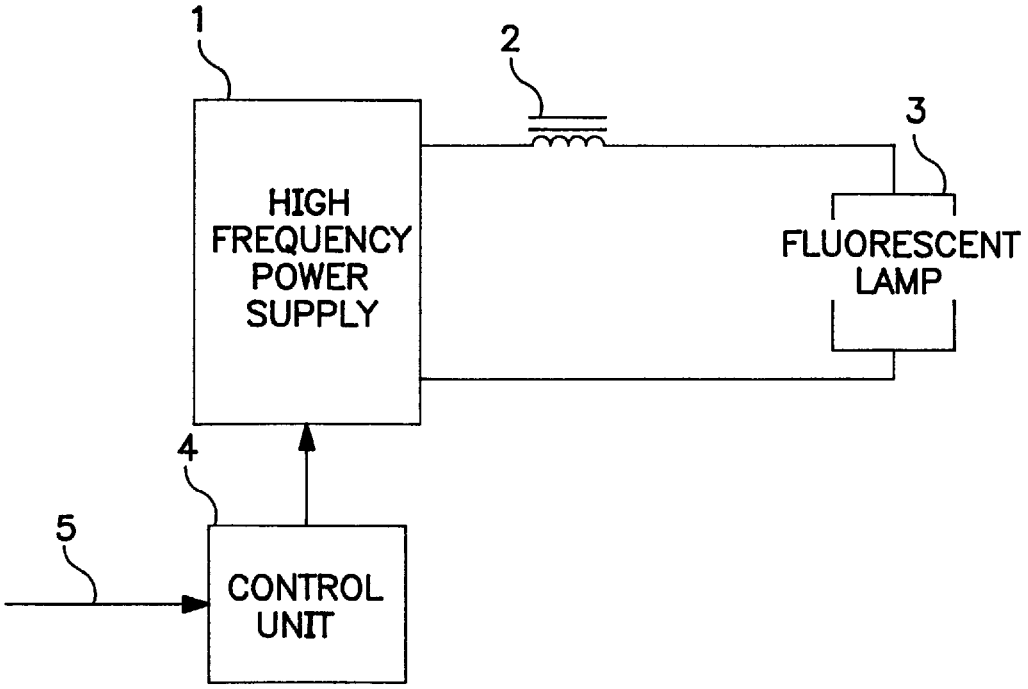
FIG. 23 is a block diagram for indicating the arrangement of the conventional dimming apparatus for the fluorescent lamp.
Figure 24:
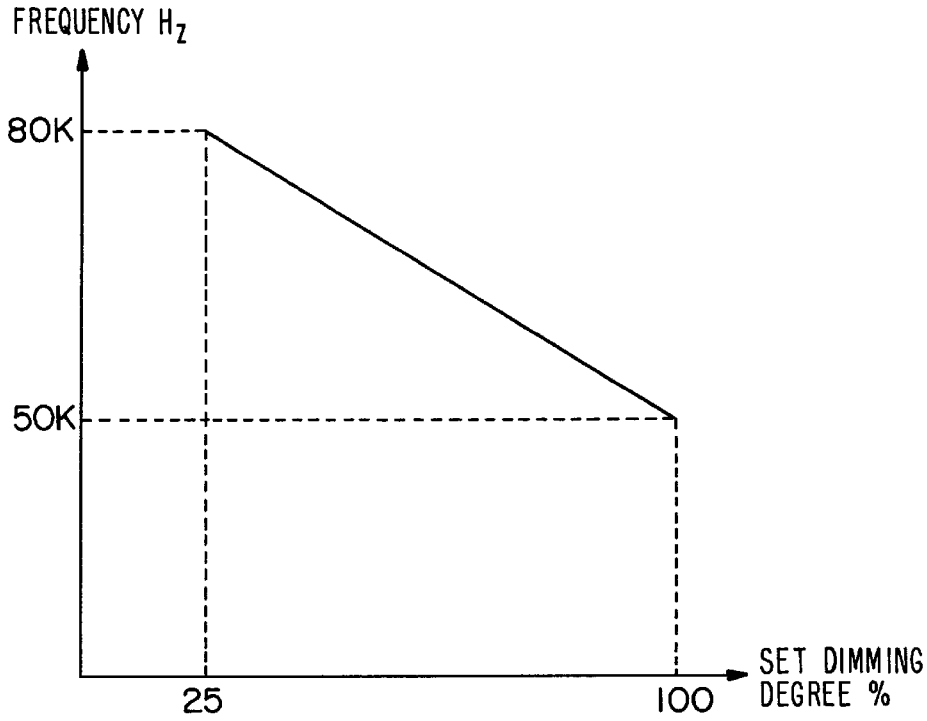
FIG. 24 is a characteristic diagram of the output frequency of the high frequency power supply with respect to the set dimming degree.

It should be noted that the same reference numerals shown in the conventional apparatus of FIG. 23 will be employed as these for indicating the same, or similar portions of the inventive apparatus indicated in FIG. 1. As new reference numeral 6 indicates a lamp voltage detecting circuit for detecting a voltage of the lamp 3. A detection voltage of this lamp voltage detecting circuit 6 is entered into the control unit 4. The control unit 4 intermittently controls the output frequency of the high frequency power supply 1 in such a manner that the frequency-controlled output frequency of the high frequency power supply 1 becomes higher than the dimming frequency obtained in response to the dimming signal 5, so that a current supplied to the fluorescent lamp 3 is periodically changed into a low current. Also, in the case that the output frequency of the high frequency power supply 1 is higher than the above-described dimming frequency, the control unit 4 sets an upper limit frequency of the output frequency of the high frequency power 1 based upon the detection voltage of the lamp voltage detecting circuit 6, so that the output frequency of the high frequency power supply 1 is controlled to be lower than, or equal to this upper limit frequency.

Figure 2:
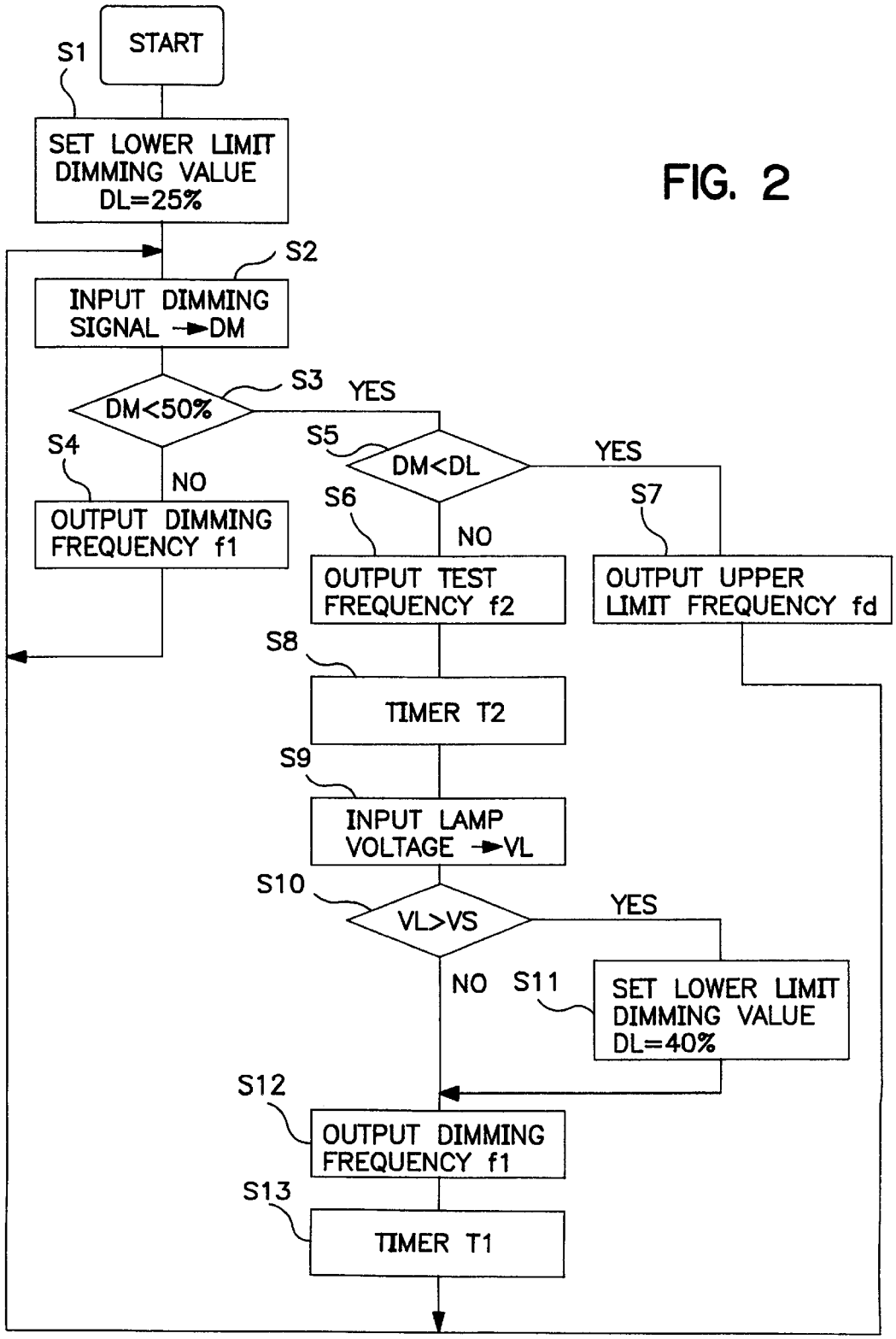
FIG. 2 is an operation flow chart of a control unit employed in the embodiment mode 1.

Next, operations of the embodiment mode 1 will be explained with reference to a flow chart indicated in FIG. 2. FIG. 2 is an operation flow chart of the control unit 4, and when the power supply is turned ON, the operation of the control unit 4 is commenced from START.

At a step S1, the lower limit dimming setting operation is initialized. In the embodiment mode 1, a lower limit dimming set value DL is selected to be 25% as an initial value. A dimming degree of 25% implies a light output rate of the lamp 3. When the rated power is inputted to the lamp 3 in the normal temperature (25° C.), the dimming rate is recognized as 100%.

At a step S2, the dimming signal 5 which constitutes a set dimming degree is entered into the control unit 4 so as to acquire the set dimming degree as an internal signal DM.

At a step S3, the control unit 4 checks as to whether or not the set dimming degree DM is larger than, or smaller than a predetermined dimming degree. In the embodiment mode 1, this predetermined dimming degree is selected to be 50%. At the step S3, when the set dimming degree DM is higher than, or equal to 50% (no), the control operation is advanced to a step S4, whereas when the set dimming degree DM is lower than, or equal to 50% (yes), the control operation is advanced to another step S5.

At this step S4, the control unit 4 outputs a dimming frequency f1 corresponding to the set dimming degree DM to the high frequency power supply 1. When this process operation of the step S4 is accomplished, the control operation is returned to the step S2 at which the same operation is repeatedly carried out.

At the step S5, the control unit 4 checks as to whether or not the set dimming degree DM is larger than the lower limit dimming set value DL. When the set dimming degree DM is larger than the lower limit dimming set value DL (no), the control operation is advanced to a step S6, whereas when the set dimming degree DM is smaller than the lower limit dimming set value DL (yes), the control operation is advanced to a step S7.

At the step S6, the control unit 4 controls the high frequency power supply 1 to output a frequency f2 higher than the dimming frequency f1. For the sake of an easy explanation, the frequency f2 is referred to as a test frequency. In this embodiment mode 1, the test frequency f2 is set to such a frequency equal to 20% of the set dimming degree.

At the step S7, the control unit 4 controls the high frequency power supply 1 to output an upper limit frequency fd. The upper limit frequency fd is equal to a frequency for setting a lower limit dimming value, and is such a frequency equivalent to 25% of the set dimming degree when the power supply is turned ON. When the process operation defined at the step S7, the control operation is returned to the step S2.

At a step S8, a timer with predetermined time T2 is actuated, and when the timer set time T2 has passed, the control operation is advanced to a step S9.

At the step S9, the control unit 4 enters thereinto the detection voltage of the lamp voltage detecting circuit 6 to acquire this detection voltage as an internal signal VL.

At a step S10, the control unit 4 checks as to whether or not the lamp voltage VL is higher than a preset threshold value voltage VS. When the lamp voltage VL is lower than the threshold value voltage VS (no), the control operation is advanced to a step S12, whereas when the lamp voltage VL is higher than the threshold value voltage VS (yes), the control operation is advanced to a step S11.

At the step S11, the lower limit dimming setting operation is again set. In this embodiment mode 1, the lower limit dimming set value DL is again set to 40%.

At a step S12, the control unit 4 controls the high frequency power supply 1 to output the dimming frequency f1.

At a step S13, the timer T1 is operated. When the timer set time T1 has passed, the control operation is returned to the step S2.

Next, overall operations will now be explained with reference to waveform diagrams indicated in FIG. 3 to FIG. 6.

Figure 3:
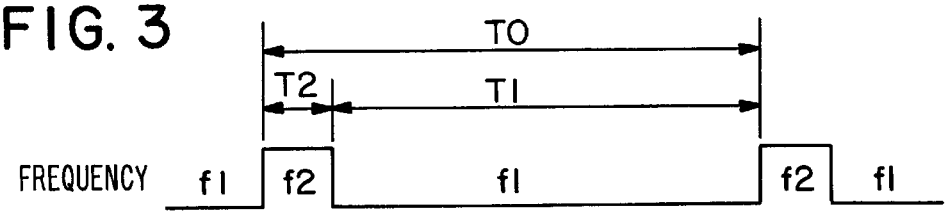
FIG. 3 is a waveform diagram of an output frequency of a high frequency power supply 1 in the embodiment mode 1.
Figure 4:
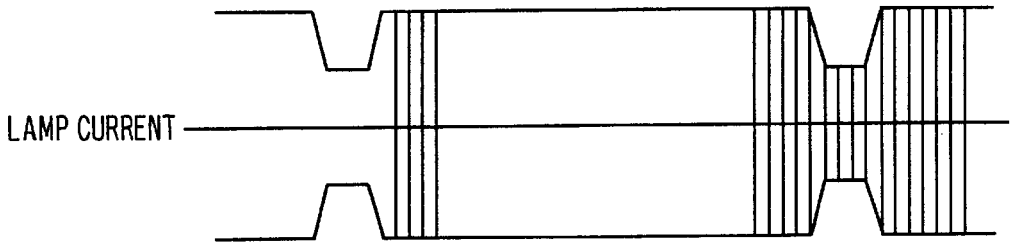
FIG. 4 is a waveform diagram of a lamp current flowing through a fluorescent lamp 3 in the embodiment mode 1.
Figure 5:
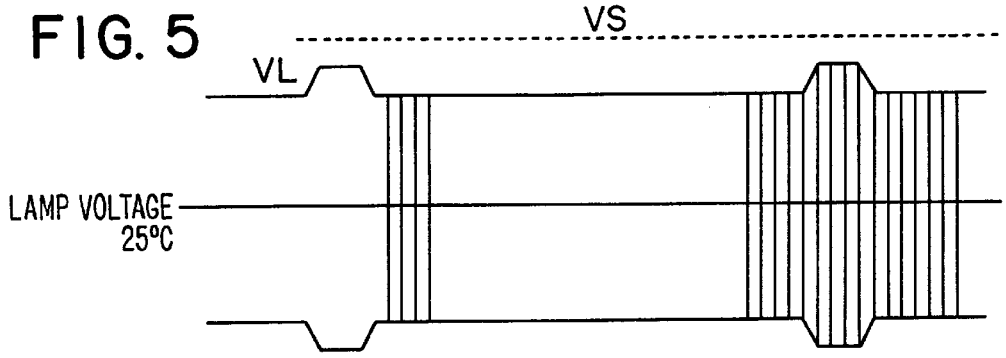
FIG. 5 is a waveform diagram of a lamp voltage applied to the fluorescent lamp 3 in a temperature of 25° C. in the embodiment mode 1.
Figure 6:
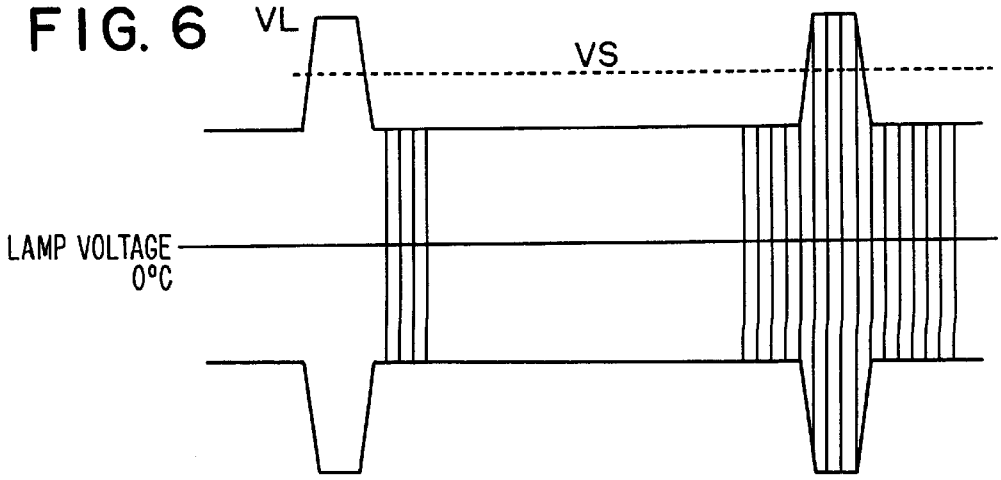
FIG. 6 is a waveform diagram of a lamp voltage applied to the fluorescent lamp 3 in a temperature of 0° C. in the embodiment mode 1.

FIG. 3 is a schematic diagram for representing a transition of the frequency of the high frequency power supply 1, FIG. 4 indicates a waveform of a lamp current flowing through the lamp 3, FIG. 5 shows a waveform of a lamp voltage at the normal temperature (25° C.), and FIG. 6 represents a waveform of a lamp voltage in a low temperature (0° C.). Also, these drawings are waveform diagrams in such a case that the dimming signal 5 becomes lower than, or equal to the dimming degree of 50%.

As shown in FIG. 3, in response to the control signal supplied from the control unit 4, the frequency of the high frequency power supply 1 repeatedly represents the dimming frequency f1 and the test frequency f2 in an alternate manner. Since the impedance of the coil 2 is varied in accordance with the frequency, when the frequency is changed from the dimming frequency f1 to the test frequency f2, the current flowing through the lamp 3 is decreased during the timer set time T2, as indicated in FIG. 4. Also, as shown in FIG. 5, the lamp voltage in the temperature of 25° C. is increased in the time period T2 during which the lamp current is decreased, but is not reached to the threshold value VS.

On the other hand, the lamp voltage in the temperature of 0° C. is increased to a voltage exceeding the threshold value voltage VS for a time period of the timer setting time T2, as shown in FIG. 6. As previously explained, in FIG. 2, as a result of judging of the lamp voltage at the step S10, when the lamp voltage VL becomes higher than the threshold value voltage VS, the lower limit dimming set value DL is changed into 40% at the step S11.

Figure 25:
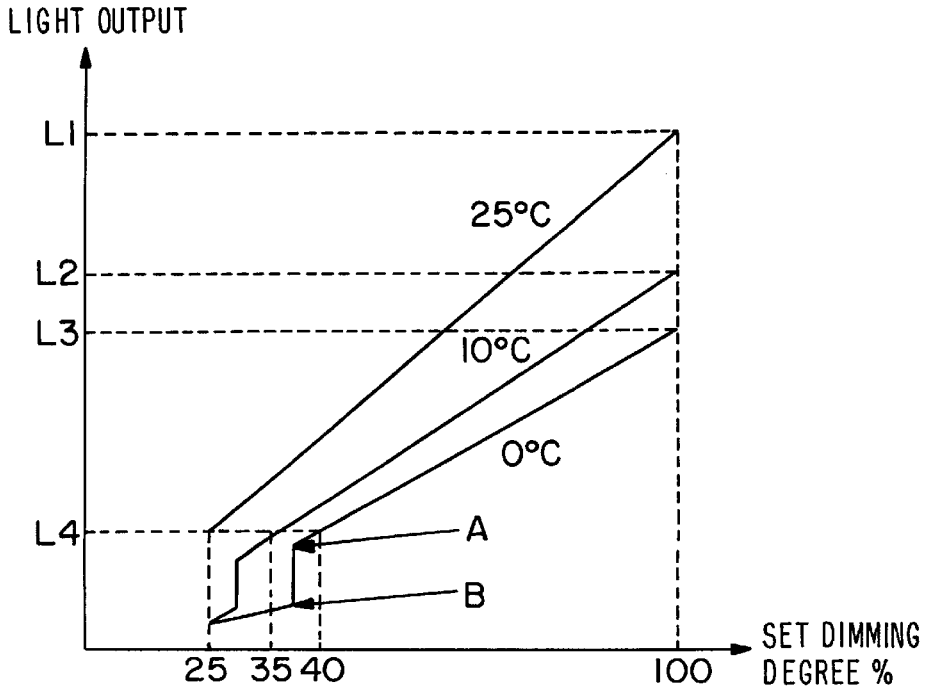
FIG. 25 is a characteristic diagram of a light output with respect to the set dimming degree.

As a result, thereafter, even when the dimming signal 5, namely the set dimming degree is smaller than, or equal to 40%, the control unit 4 judges at a step S5 that the set dimming degree DM<the lower limit dimming set value DL. At a step S7, the high frequency power supply 1 is operated in the frequency equivalent to the set dimming degree of 40%. As apparent from FIG. 25, the set dimming degree of 40% corresponds to such an area where the lamp 3 is turned ON under stable condition. At this time, the light output is equal to such a light output based on the lower limit dimming set value of 25% which is set by the initial setting operation in the case of the normal temperature (25° C.) at the step S1. Even when the set dimming degree of 40% is set to the lower limit value, the light output from the lamp can be sufficiently dimmed.

As previously explained, the lamp 3 is not dimmed in the unstable turn-ON area even under such a low temperature as 0° C. As a result, there are no possibilities that the light output is rapidly lowered, and the flicker phenomenon occurs. Also, since the lamp current is periodically reduced in the repeating manner, if the repetition frequency becomes higher than, or equal to 50 Hz, this flicker phenomenon cannot be felt by human eyes.

It should be noted that in the embodiment mode 1, when the set dimming degree DM set by the dimming signal 5 is smaller than, or equal to 50%, the lamp current is decreased, namely, the control unit controls so that the test frequency f2 is output during a predetermined time period. Alternatively, even when the set dimming degree is not limited to 50%, a similar effect may be achieved.

Also, in the embodiment mode 1, in such a case that the set dimming degree DM set by the dimming signal 5 is smaller than, or equal to 50%, and also while the set dimming degree DM is larger than the lower limit dimming set value DL, the lamp voltage VL is higher than the threshold value VS, the lower limit dimming set value DL is changed into 40%. Alternatively, the lower limit dimming set value DL may be independently set, depending upon the use temperature range of the lamp 3 and the sort of this lamp 3. It is preferably set the lower limit dimming set value DL within a range from 5% to 60% with respect to the dimming degree defined when the rated power is inputted to the fluorescent lamp 3 in the normal temperature.

Figure 7:
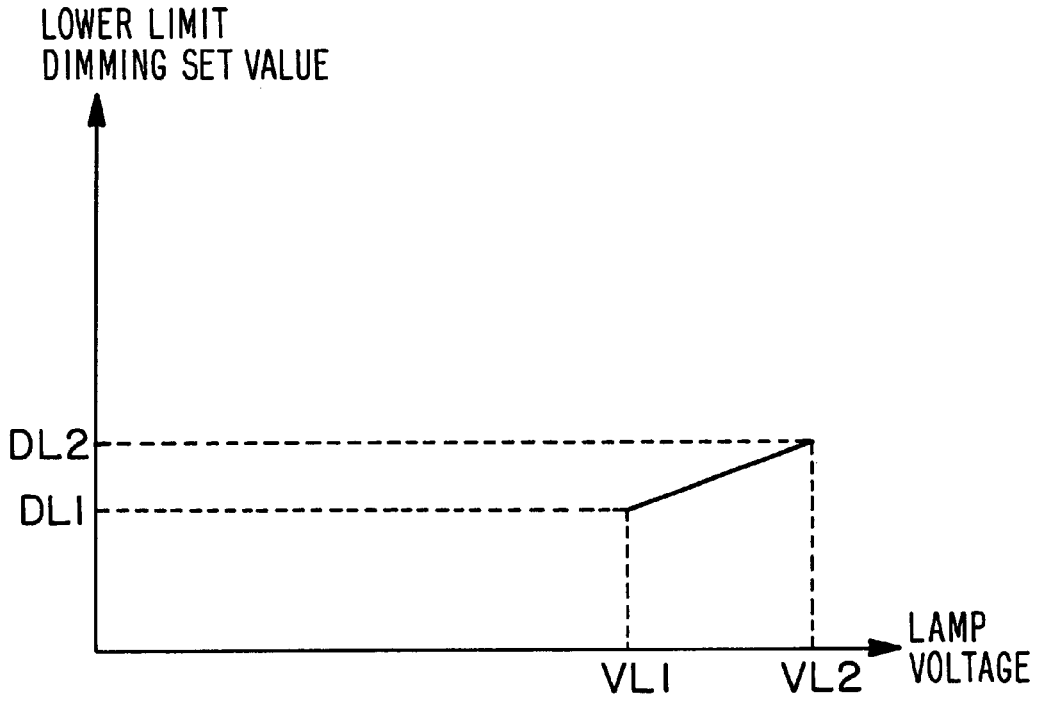
FIG. 7 is a graphic representation for indicating a relationship between a lamp voltage and a lower limit setting value of dimming employed in an expansion of the embodiment mode 1.

Also, as indicated in FIG. 7 the lower limit dimming set value defined at the step S11 may be continuously varied from DL1 to DL2 in response to the lamp voltage. In this alternative case, when the lamp voltage is low, the lower limit dimming set value is selected to be a low value. In other words, when the lamp voltage is equal to VL1, the lower limit dimming set value is set to the lower limit dimming set value DL1. On the other hand, when the lamp voltage is high, the lower limit dimming set value is selected to be a high value. In other words, when the lamp voltage is equal to VL2, the lower limit dimming set value is set to the lower limit dimming set value DL2. In this case, the processed content of the step S11 shown in FIG. 2 must be changed into such a processed content. That is, the lower limit dimming set value is variable in response to the lamp voltage VL.

Also, in the waveform shown in FIG. 3, a relationship between the time period T0 at which the frequency of the high frequency power supply 1 is intermittently changed, and the dimming frequency f1 is suitably selected to be $T0 \geqq 3/f1$. The above-described time period T0 at which the frequency is intermittently changed may be suitably selected to be $T0 \geqq 0.1$ ms. This time period T0 and another time period T2 may be preferably selected to $T2 \leqq T0/2$. In the time period T2, the test frequency f2 higher than the dimming frequency f1 is outputted.

Embodiment Mode 2

Figure 8:
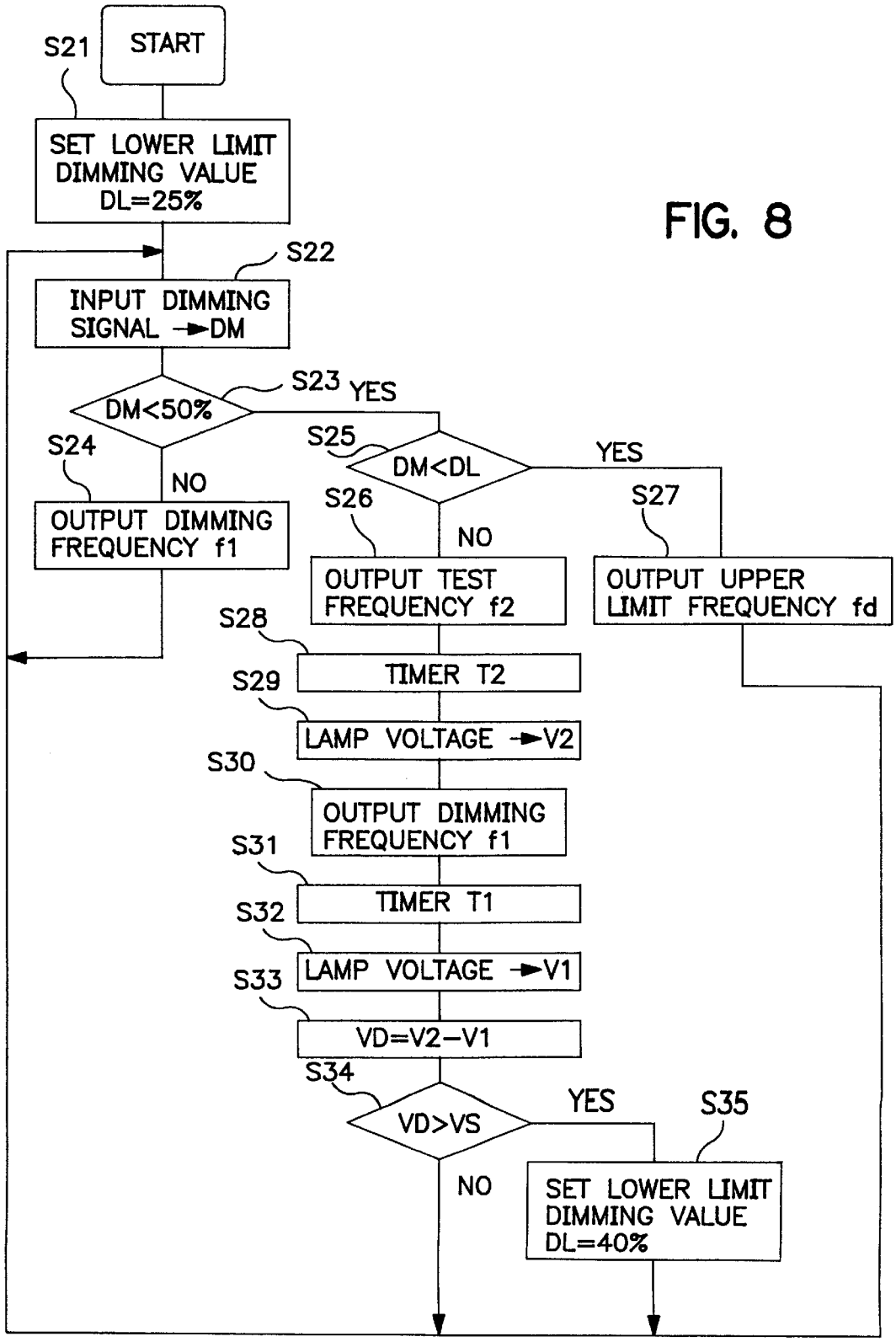
FIG. 8 is an operation flow chart of a control unit employed in an embodiment mode 2 of the present invention.

Next, FIG. 8 is a flow chart for representing operations of a control unit 4 according to an embodiment mode 2 corresponding to the flow chart of the embodiment mode 1 shown in FIG. 2. An arrangement according to this embodiment mode 2 is equipped with the arrangement similar to that of the embodiment mode 1 shown in FIG. 1.

Subsequently, operations related to the embodiment mode 2 will now be explained with reference to the flow chart shown in FIG. 8.

First, since the power supply is turned ON, the operation of the control unit 4 is commenced. Since operations defined from a step S21 to a step S28 are carried out in a similar manner to the operations defined from the step S1 to the step S8 of the flow chart of the embodiment mode 1 shown in FIG. 2, descriptions thereof are omitted.

At a step S29, a detection voltage of the lamp voltage detecting circuit 6 is inputted into the control unit 4 so as to acquire this detection voltage as an internal signal V2.

At a step S30, the control unit 4 controls the high frequency power supply 1 to output the dimming frequency f1.

At a step S31, the timer T1 is operated. When the timer set time has passed, the control operation is returned to a step 32.

At the step S32, a lamp voltage is again applied from the lamp voltage detecting circuit 6 to the control unit 4 so as to acquire this lamp voltage as an internal signal V1.

At a step S33, the control unit 4 calculates a difference voltage VD between a lamp voltage V1 and a lamp voltage V2 as an internal signal.

At a step S34, the control unit 4 checks as to whether or not the difference voltage VD is lower than a preset threshold value voltage VS. When the difference voltage VD is higher than the threshold value voltage VS (yes), the control operation is advanced to a step S35. Conversely, when the difference voltage VD is lower than the threshold value voltage VS, the control operation is returned to the step S22.

At a step S35, the lower limit dimming set value DL is set to a predetermined dimming degree, namely 40% in the embodiment mode 2 similar to that of the embodiment mode 1.

Next, overall operations will now be explained with reference to waveform diagrams indicated in FIG. 9 to FIG. 12.

Figure 9:
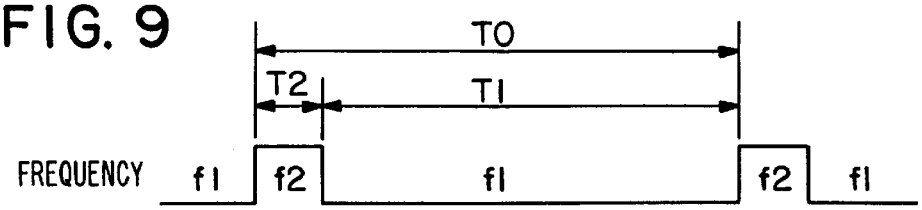
FIG. 9 is a waveform diagram of an output frequency of a high frequency power supply 1 in the embodiment mode 2.
Figure 10:
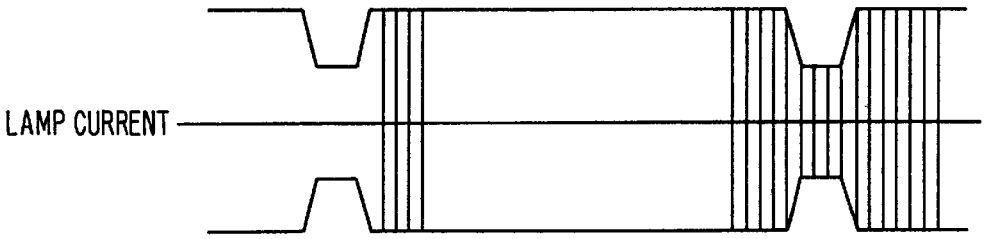
FIG. 10 is a waveform diagram of a lamp current flowing through a fluorescent lamp 3 in the embodiment mode 2.
Figure 11:
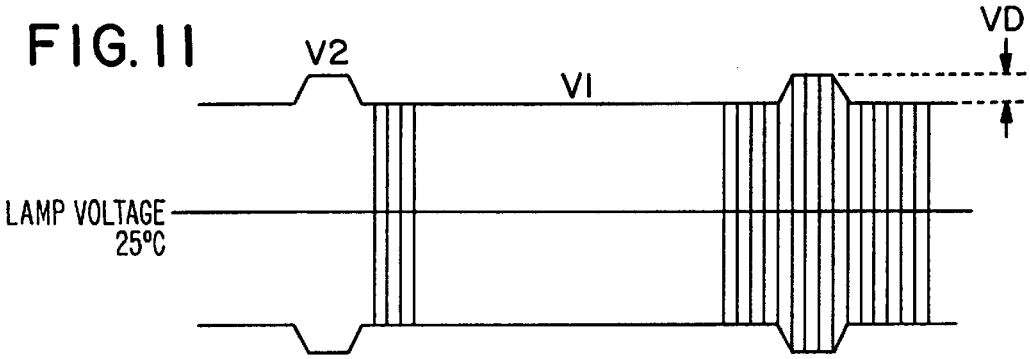
FIG. 11 is a waveform diagram of a lamp voltage applied to the fluorescent lamp 3 in a temperature of 25° C. in the embodiment mode 2.
Figure 12:
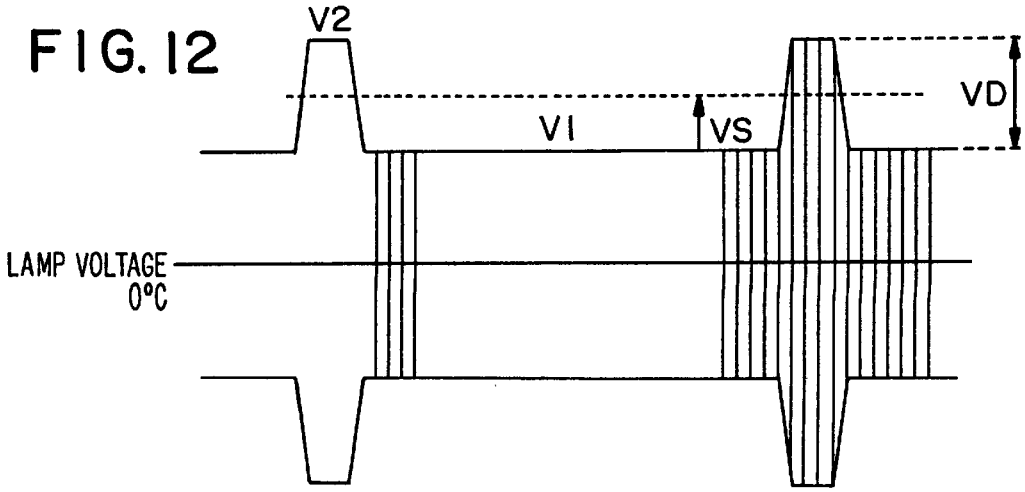
FIG. 12 is a waveform diagram of a lamp voltage applied to the fluorescent lamp 3 in a temperature of 0° C. in the embodiment mode 2.

FIG. 9 is a schematic diagram for representing a transition of the frequency of the high frequency power supply 1, FIG. 10 indicates a waveform of a lamp current flowing through the lamp 3, FIG. 11 shows a waveform of a lamp voltage at the normal temperature (25° C.), and FIG. 12 represents a waveform of a lamp voltage in a low temperature (0° C.). Also, these drawings are waveform diagrams in such a case that the dimming signal 5 becomes lower than, or equal to the dimming degree of 50%.

FIG. 9 and FIG. 10 are similar to those of the embodiment mode 1 shown in FIG. 3 and FIG. 4. In this embodiment mode 2, as represented as the voltage waveforms of the high frequency power supply 1 shown in FIG. 11 and FIG. 12, when the high frequency power supply 1 is operated at the dimming frequency f1, the lamp voltage becomes a lamp voltage V1, whereas when the high frequency power supply 1 is operated at the test frequency f2, the lamp voltage becomes a lamp voltage V2. A VD becomes a voltage difference between both the lamp voltages V1 and V2.

Also, FIG. 11 shows the lamp voltage in such a case that the atmospheric temperature of the lamp 3 is equal to 25° C., and FIG. 12 indicates the lamp voltage in such a case that the atmospheric temperature of the lamp 3 is equal to 0° C. As apparent from these drawings, when the atmospheric temperature is 0° C., the difference voltage VD is high. If the threshold value voltage VS is set to be a proper value, namely, an intermediate value between the difference voltage VD in the normal temperature (25° C.) and the difference voltage VD in the low temperature (0° C.), then the lower limit dimming set value in the lower temperature can be set to 40% similar to the embodiment mode 1.

As previously described, at the step S34 of the flow chart shown in FIG. 8, when the control unit 4 judges the difference voltage of the lamp voltages, in such a case that the difference voltage VD is higher than the threshold value voltage VS, the lower limit dimming set value DL is set to 40% at the step S35.

As a result, thereafter, even when the dimming signal 5, namely the set dimming degree is smaller than, or equal to 40%, the control unit 4 judges at a step S25 that the set dimming degree DM<the lower limit dimming set value DL. At a step S27, the high frequency power supply 1 is operated in the frequency equivalent to the set dimming degree of 40%.

As previously explained, according to the embodiment mode 2, similar to the embodiment mode 1, the lamp 3 is not dimmed in the unstable turn-ON area even under such a low temperature as 0° C. As a result, there are no possibilities that the light output is rapidly lowered, and the flicker phenomenon occurs.

Embodiment Mode 3

Figure 13:
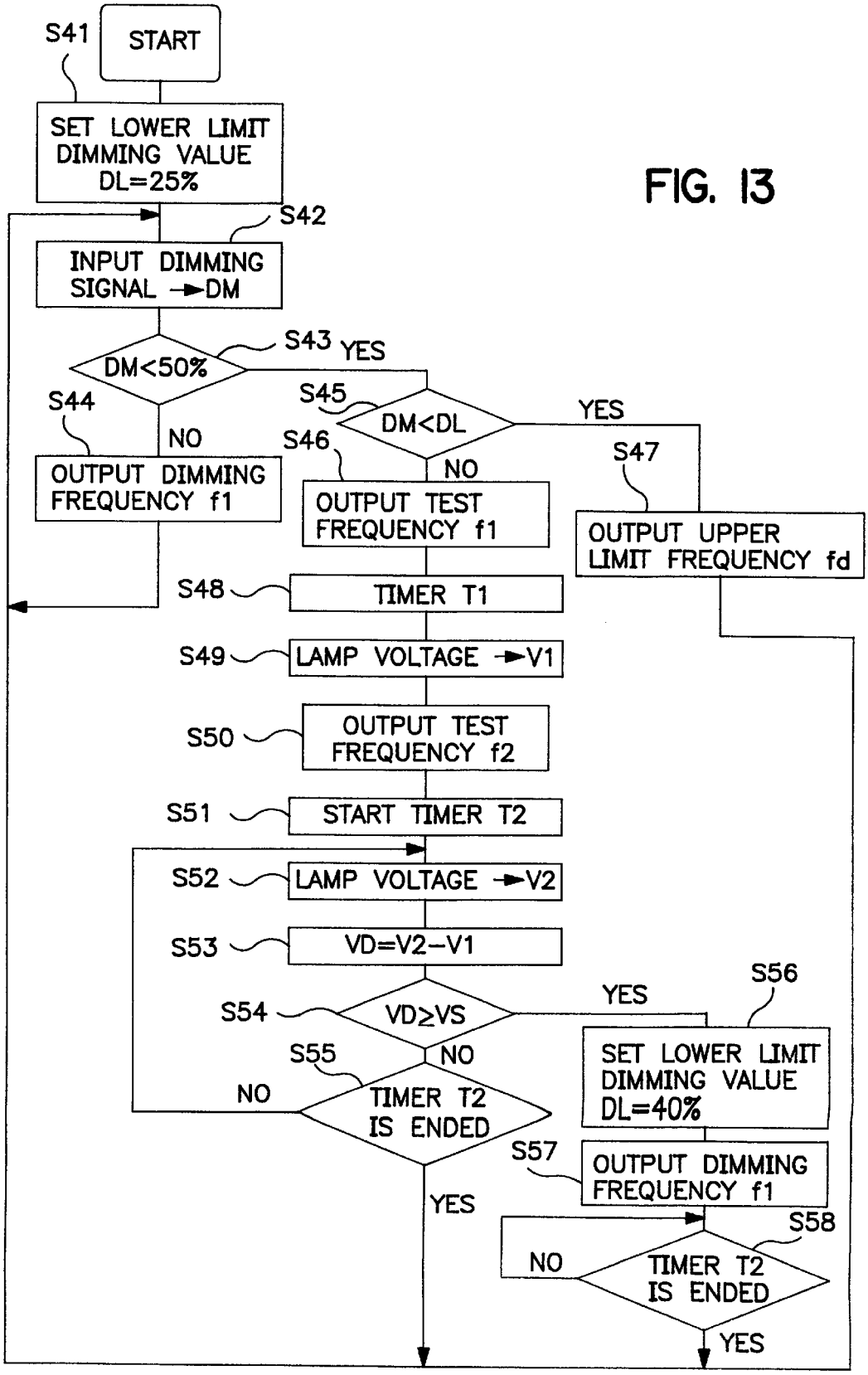
FIG. 13 is an operation flow chart of a control unit employed in an embodiment mode 3 of the present invention.

Next, FIG. 13 is a flow chart for representing operations of a control unit 4 according to an embodiment mode 3 corresponding to the flow chart of the embodiment mode 1 shown in FIG. 2. An arrangement according to the embodiment mode 3 is equipped with the arrangement similar to that of the embodiment mode 1 shown in FIG. 1.

Subsequently, operations related to the embodiment mode 3 will now be explained with reference to the flow chart shown in FIG. 13.

First, since the power supply is turned ON, the operation of the control unit 4 is commenced. Since operations defined from a step S41 to a step S45 are carried out in a similar manner to the operations defined from the step S1 to the step S5 of the flow chart of the embodiment mode 1 shown in FIG. 2, descriptions thereof are omitted.

At the step S45, the control unit 4 checks as to whether or not the set dimming degree DM is larger than the lower limit dimming set value DL. When the lower limit dimming set value DM is larger than the set dimming degree DL (no), the control operation is advanced to a step S46, whereas when the lower limit dimming set value DM is smaller than the set dimming degree DL (yes), the control operation is advanced to a step S47.

At the step S46, the control unit 4 controls the high frequency power supply 1 to output a dimming frequency f1.

At the step S47, the control unit 4 controls the high frequency power supply 1 to output an upper limit frequency fd. Similar to the embodiment mode 1, the upper limit frequency fd is equal to a frequency in correspondence with the lower limit dimming set value DL, and is such a frequency equivalent to 25% of the set dimming degree during the initial setting operation when the power supply is turned ON. When the process operation defined at the step S47, the control operation is returned to the step S42.

At a step S48, a timer T1 is actuated, and when the timer set time T1 has passed, the control operation is advanced to a step S49.

At the step S49, the control unit 4 enters thereinto the detection voltage of the lamp voltage detecting circuit 6 to acquire this detection voltage as an internal signal V1.

At a step S50, the control unit 4 controls the high frequency power supply 1 to output the test frequency f2.

At a step S51, the timer T2 starts to be operated.

At a step S52, a detection voltage is again applied from the lamp voltage detecting circuit 6 to the control unit 4 so as to acquire this detection voltage as an internal signal V2.

At a step S53, the control unit 4 calculates a difference voltage VD between a lamp voltage V1 and a lamp voltage V2 as an internal signal.

At a step S54, the control unit 4 checks as to whether or not the difference voltage VD is lower than a preset threshold value voltage VS. When the difference voltage VD is lower than, or equal to the threshold value voltage VS (no), the control operation is advanced to a step S55. Conversely, when the difference voltage VD is higher than, or equal to the threshold value voltage VS (yes), the control operation is advance to the step S56.

At a step S55, the control unit 4 judges as to whether or not the timer T2 is accomplished (yes). When the timer T2 is accomplished, the control operation is returned to the step S42. On the other hand, when the timer T2 is not yet accomplished, the control operations defined after the step S52 are repeatedly carried out.

At a step S56, the lower limit dimming set value DL is changed to be 40%.

At a step S57, the control unit 4 returns the present frequency to the dimming frequency f1 (otherwise upper limit frequency fd).

At a step S58, the control unit 4 judges as to whether or not the timer T2 is accomplished. When the timer T2 is accomplished (yes), the control operation is returned to the step S42.

Next, overall operations will now be explained with reference to waveform diagrams indicated in FIG. 14 to FIG. 17.

Figure 14:
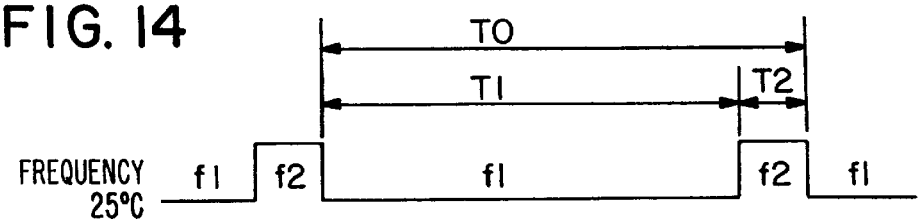
FIG. 14 is a waveform diagram of an output frequency of a high frequency power supply 1 in a temperature of 25° C. in the embodiment mode 3.
Figure 15:
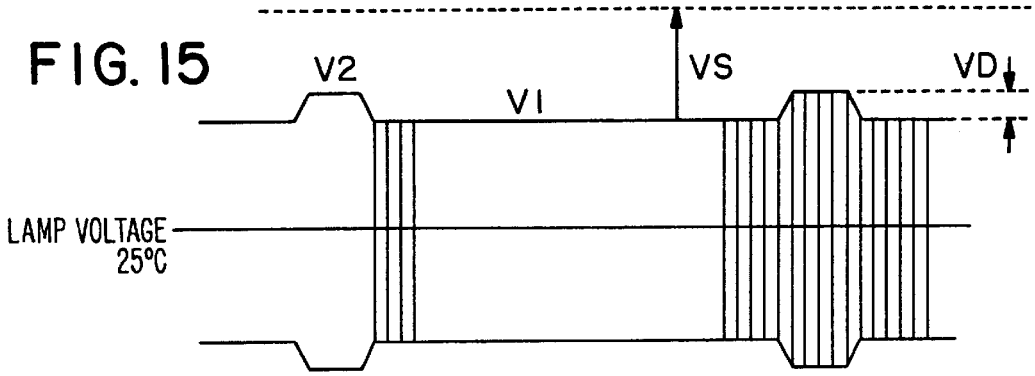
FIG. 15 is a waveform diagram of a lamp voltage applied to the fluorescent lamp 3 in the temperature of 25° C. in the embodiment mode 3.
Figure 16:
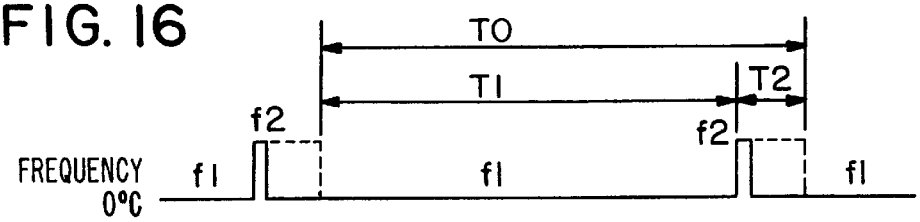
FIG. 16 is a waveform diagram of an output frequency of a high frequency power supply 1 in a temperature of 0° C. in the embodiment mode 3.
Figure 17:
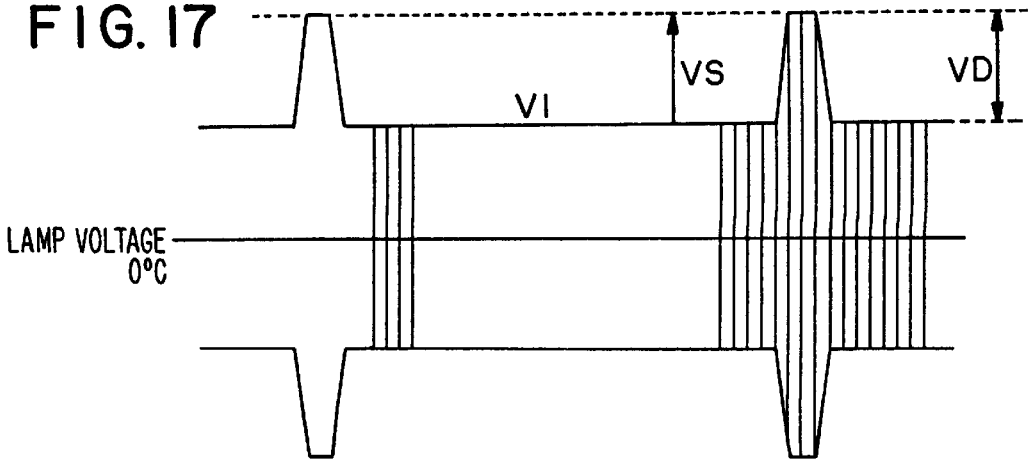
FIG. 17 is a waveform diagram of a lamp voltage applied to the fluorescent lamp 3 in the temperature of 0° C. in the embodiment mode 3.

FIG. 14 is a schematic diagram for representing a transition of the frequency of the high frequency power supply 1 in the temperature of 25° C., FIG. 15 shows a waveform of a lamp voltage at the temperature of 25° C., FIG. 16 represents a schematic diagram of a transition of a frequency in the temperature of 0° C., and FIG. 17 indicates a lamp voltage in the temperature of 0° C.

As indicated in FIG. 14 and FIG. 15, since the difference voltage VD of the lamp voltage is low with respect to the threshold value voltage VS in the temperature of 25° C., the test frequency f2 is outputted from the high frequency power supply 1 during the timer T2.

On the other hand, as indicated in FIG. 16 and FIG. 17, in the temperature of 0° C., since the difference voltage VD exceeds the threshold value voltage VS while the timer T2 is actuated (VD≧VS), the present frequency is switched from the test frequency f2 to the dimming frequency f1. At this time, since the timer T2 is continuously actuated without any interrupt, the same operation is repeatedly performed after the timer T2 is accomplished. As a result, the frequency change time period T0 of the high frequency power supply 1 is always constant.

As previously explained, according to the embodiment mode 3, similar to the embodiment mode 1, the lamp 3 is not dimmed in the unstable turn-ON area even under such a low temperature as 0° C. As a result, there are no possibilities that the light output is rapidly lowered, and the flicker phenomenon occurs. Also, since the minimum time during which the lamp current is experimentally reduced is required, the lamp can be turned ON under more stable condition.

Embodiment Mode 4

Figure 18:
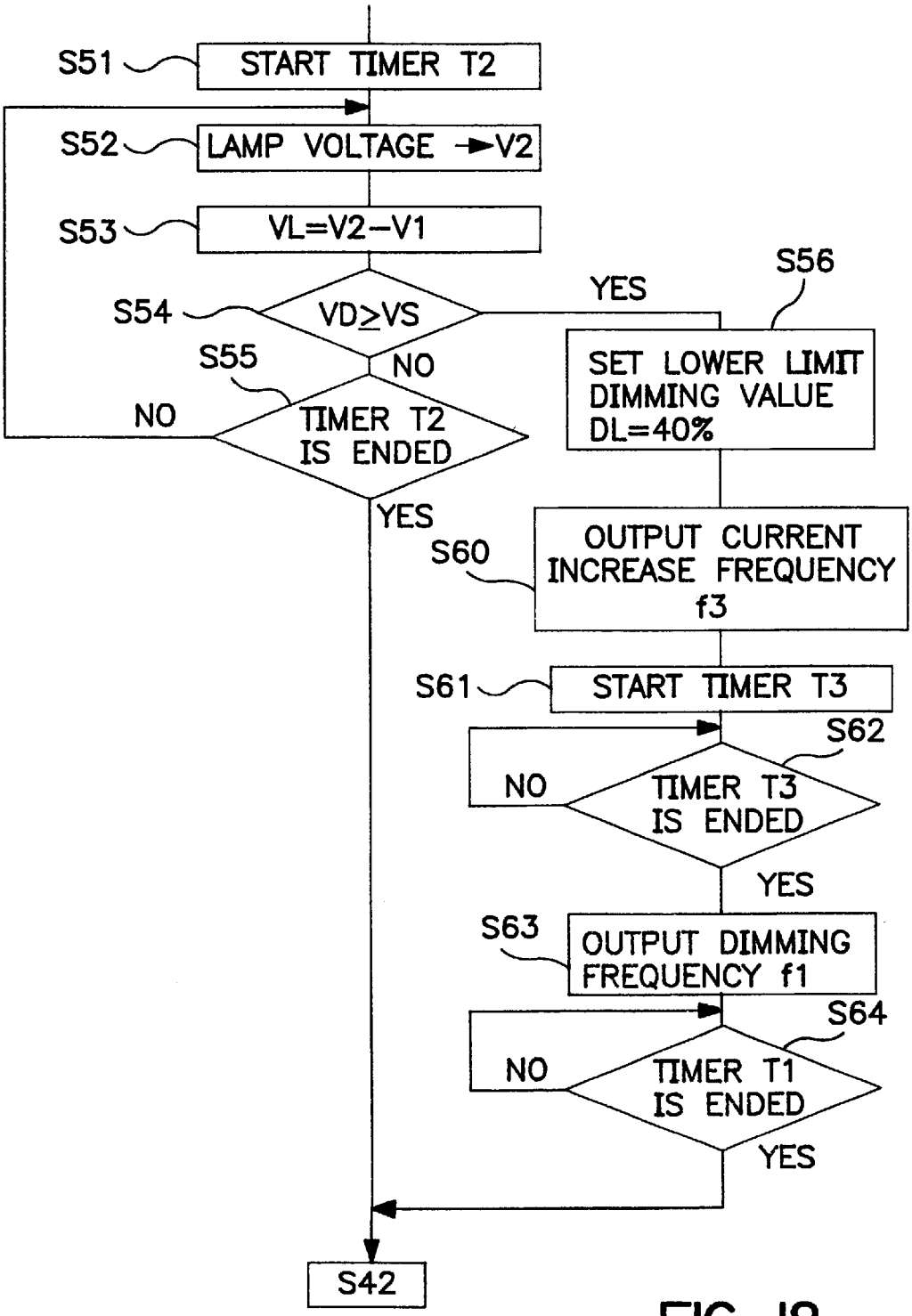
FIG. 18 is an operation flow chart of a control unit employed in an embodiment mode 4 of the present invention.

Next, FIG. 18 is a flow chart for representing operations of a control unit 4 according to an embodiment mode 4 corresponding to the flow chart of the embodiment mode 1 shown in FIG. 2. An arrangement according to this embodiment mode 4 is equipped with the arrangement similar to that of the embodiment mode 1 shown in FIG. 1.

Subsequently, operations related to the embodiment mode 4 will now be explained with reference to the flow chart shown in FIG. 18.

First, in the embodiment mode 4 shown in FIG. 18, the completely same operations as defined from the step S41 to the step S56 as those of the embodiment mode 3 shown in FIG. 13 are carried out.

That is to say, at a step S54, the control unit 4 checks as to whether or not a voltage difference VL is higher than a preset threshold value voltage VS. When the voltage difference VL is lower than the threshold value voltage VS (no), the control operation is advanced to a step S55. Conversely, when the voltage difference VL is higher than the threshold value voltage VS (yes), the control operation is advanced to a step S16.

At a step S55, the control unit 4 judges as to whether or not the timer T2 is accomplished. When the timer T2 is not yet accomplished, the control operation is returned to the step S52. On the other hand, when the timer T2 is accomplished, the control operation is returned to the step S42 at which the control operations defined from the first step S42 are repeatedly carried out.

At a step S56, the lower limit dimming frequency DL is changed to be 40%.

While the above-described control operations are similar to those of the embodiment mode 3, the below-mentioned control operations of the embodiment mode 4 are different therefrom.

At a step S60, the control unit 4 controls the high frequency power supply 1 to output a current increase frequency f3. The current increase frequency f3 is such a frequency lower than either the dimming frequency or the upper limit frequency f1. This current increase frequency f3 may cause a substantially large current to forcibly flow through the lamp 3. This is because such an unstable operation occurred when the lamp current is decreased may be recovered to the stable condition by rapidly increasing the lamp current.

At a step S61 and a step S62, a new timer T3 is actuated. When the timer T3 is accomplished, the control unit 4 controls the high frequency power supply 1 to output the dimming frequency f1 (otherwise, upper limit frequency fd) at a step S63.

Furthermore, at a step S64, when the timer T2 is accomplished the control operation is returned to the step S42 similar to the embodiment mode 3 shown in FIG. 13, at which a similar process operation is repeatedly performed.

Next, overall operations will now be explained with reference to waveform diagrams indicated in FIG. 19 to FIG. 22.

Figure 19:
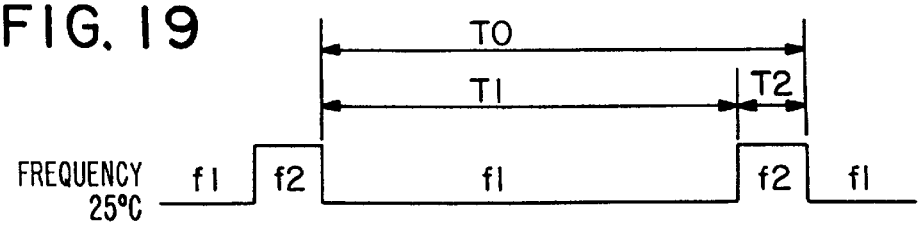
FIG. 19 is a waveform diagram of an output frequency of a high frequency power supply 1 in a temperature of 25° C. in the embodiment mode 4.
Figure 20:
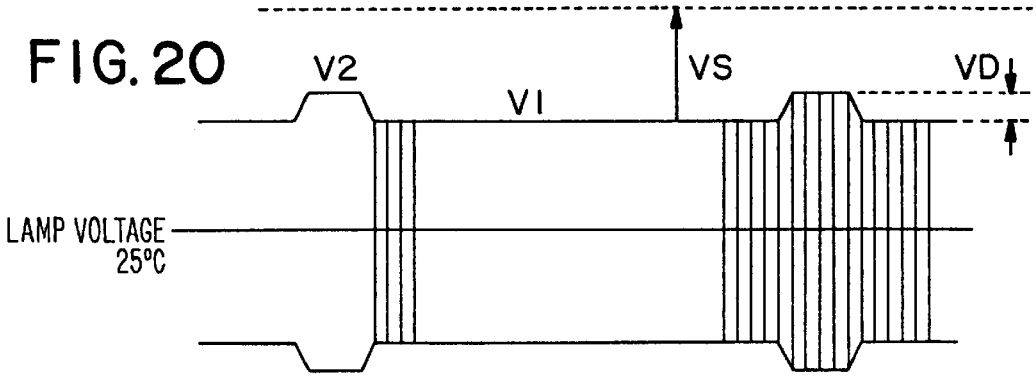
FIG. 20 is a waveform diagram of a lamp voltage applied to the fluorescent lamp 3 in the temperature of 25° C. in the embodiment mode 4.
Figure 21:
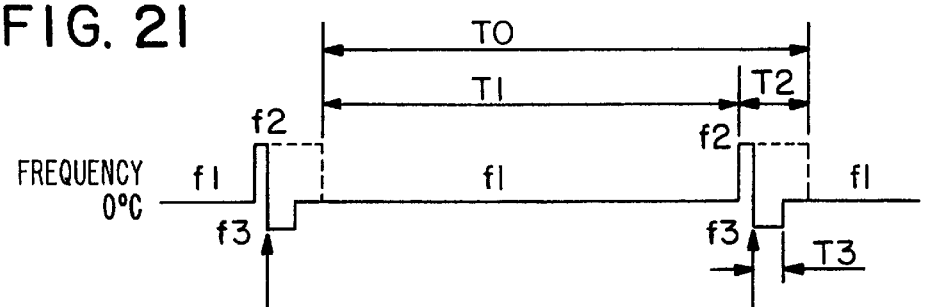
FIG. 21 is a waveform diagram of an output frequency of a high frequency power supply 1 in a temperature of 0° C. in the embodiment mode 4.
Figure 22:
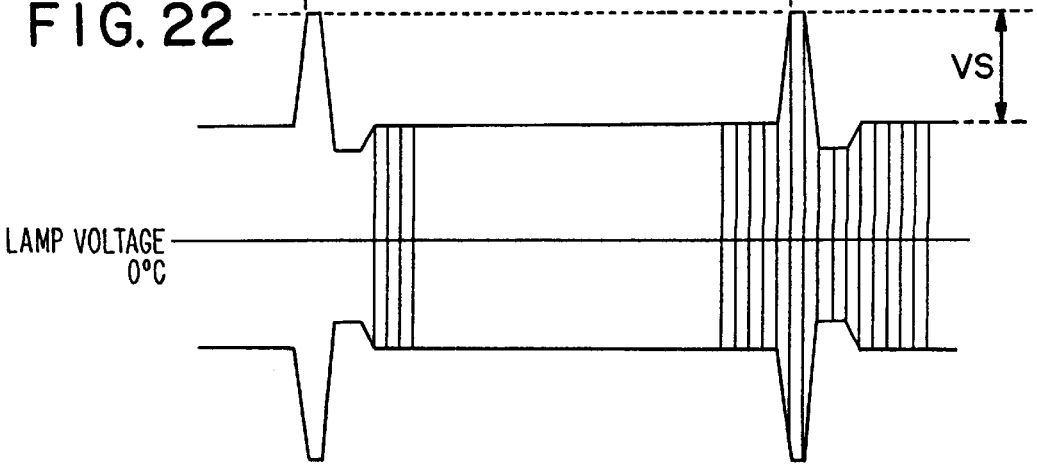
FIG. 22 is a waveform diagram of a lamp voltage applied to the fluorescent lamp 3 in the temperature of 0° C. in the embodiment mode 4.

FIG. 19 is a schematic diagram for representing a transition of a frequency in the temperature of 25° C. FIG. 20 shows a waveform of a lamp voltage at the same temperature (25° C.). FIG. 21 is a schematic diagram for showing a transition of a frequency in the temperature of 0° C., and FIG. 22 shows a lamp voltage at the same temperature (0° C.).

Since the difference voltage VD of the lamp voltage is low with respect to the threshold value voltage VS in the temperature of 25° C., a test frequency f2 is outputted from the high frequency power supply 1 during the timer T2. On the other hand, in the temperature of 0° C., since the difference voltage VL exceeds the threshold value voltage VS while the timer T2 is actuated (VL≧VS), the present frequency is switched from the test frequency f2 to the current increase frequency f3. Then, since the timer 3 is actuated, the current increase frequency f3 is continuously outputted.

When the timer 3 is accomplished, the dimming frequency f1 (otherwise, upper limit frequency fd) is outputted from the high frequency power supply. At this time, since the timer T2 is continuously operated without any interruption, after the timer T2 is accomplished, the control operation is advanced to the step S42 at which the same operation is repeatedly carried out.

As a consequence, the frequency change time period T0 of the high frequency power supply 1 is always constant.

As previously explained, according to the embodiment mode 4, similar to the embodiment mode 1, the lamp 3 is not dimmed in the unstable lamp turn-ON area even under such a low temperature as 0° C. As a result, there are no possibilities that the light output is rapidly lowered, and the flicker phenomenon occurs. Also, since the minimum time during which the lamp current experimentally reduced is necessarily required, and furthermore the lamp current is increased during the switching operation, the lamp can be turned ON under further stable condition.

As previously explained, in accordance with the present invention, the frequency is increased in such a manner that the lamp current is intermittently decreased from the dimming lamp current, and the upper limit control frequency is set from a change in the lamp current at this time. As a consequence, the fluorescent lamp is dimmed up to such an area that the fluorescent lamp can be turned ON under stable condition, and the limiter is actuated in the dimming degree lower than this dimming operation. Therefore, there is no case that the lamp current is rapidly decreased in the discontinuous manner. Also, it is possible to avoid that the flicker phenomenon occurs at this time.

In the case that the dimming degree set by the dimming signal is smaller than, or equal to a predetermined dimming degree, the output frequency of the high frequency power supply is intermittently frequency-controlled in such a manner that the output frequency becomes such a test frequency higher than the dimming frequency from the dimming frequency based upon the dimming signal so as to intermittently decrease the lamp current. As a result, the intermittent change is carried out within the area where the lamp current is small, and thus, no sounds are produced from the lamp and the like.

Also, since the upper limit control frequency is set, the upper limit frequency value is variable, so that the light amount is not increased with the same dimming signal, as compared with that in the normal temperature.

In the case that the lamp voltage difference between the lamp voltage during the dimming operation and the lamp voltage when the lamp current is decreased is detected, and then this detected lamp voltage difference is a predetermined voltage difference, since the upper limit control frequency is set, there is no adverse influence caused by the individual differences in the lamp current/voltage characteristics.

Also, since the decrease of the lamp current is stopped when a predetermined lamp voltage difference is detected, and furthermore, the decrease time of the lamp current is minimized, even when the lamp current is decreased, the stable discharge can be obtained.

Also, after the decrease of the lamp current has been stopped, the larger current than the dimming current is supplied to the lamp during a predetermined time period and then is held for a predetermined time period. As a result, even when the lamp current is decreased, the discharge is furthermore performed under stable condition, so that the use temperature range can be extended.

Also, since the upper limit frequency value is set to the dimming degrees from 5% to 60%, even when the sort of lamp is changed, the dimming apparatus can according to the present invention can turn ON the different sorts of lamps under stable conditions.

Also, since the time period during which the lamp current is intermittently decreased is set to be longer than the time period of the dimming frequency more than, or equal to 3 times, even when the sort of lamp is changed, the dimming apparatus according to the present invention can turn ON the different sorts of lamps under stable conditions.

Also, since the time is set to be longer than, or equal to 0.1 ms, during which the lamp current is intermittently decreased, the upper limit frequency value can be firmly set.

Furthermore, since the time period during which the lamp current is intermittently decreased is made more than, or equal to two times longer than the time during which the frequency higher than the dimming frequency is outputted, the upper limit frequency value can be surely set.

FIELD OF INDUSTRIAL APPLICATION

As previously described, in accordance with the present invention, the control unit controls the output frequency of the high frequency power supply in such a manner that this output frequency becomes higher than the dimming frequency based upon the entered dimming signal in order to periodically lower the current supplied to the fluorescent lamp to the low current. Also, when the output frequency of the high frequency power supply becomes such a frequency higher than the dimming frequency, since the lower limit dimming set value is set based on the detection voltage of the lamp voltage detecting circuit, the above-described output frequency of the high frequency power supply is controlled to become lower than, or equal to the above-explained upper limit frequency in response to the lower limit dimming set value. As a consequence, the lamp can be dimmed in the continuous manner, and the flicker phenomenon of the light output can be reduced. In particular, the lamp can be turned ON under stable condition in the low temperature.

What is claimed is:

1. A dimming apparatus of a fluorescent lamp, comprising:

a fluorescent lamp;

a high frequency power supply for supplying high frequency power to said fluorescent lamp;

a control unit for controlling an output frequency of said high frequency power supply in response to an inputted light dimming signal; and a coil provided between said high frequency power supply and said fluorescent lamp, for limiting a current which flows from said high frequency power supply to said fluorescent lamp; wherein:

said dimming apparatus is further comprised of a lamp voltage detecting circuit for detecting a discharge voltage of said fluorescent lamp; and said control unit intermittently controls the output frequency of said high frequency power supply in such a manner that said output frequency becomes higher than a dimming frequency based on said dimming signal so as to periodically change a current supplied to said fluorescent lamp into a low current; and when the output frequency of said high frequency power supply becomes higher than said dimming frequency, said control unit sets a lower limit dimming set value based upon a detection voltage of said lamp voltage detecting circuit in order that the output frequency of said high frequency power supply is controlled to become lower than, or equal to a upper limit frequency in accordance with said lower limit dimming set value.

2. A dimming apparatus of a fluorescent lamp as claimed in claim 1 wherein:

when a set dimming degree based upon said inputted dimming signal is smaller than, or equal to a predetermined dimming degree, said control unit intermittently controls the output frequency of said high frequency power supply in such a manner that said output frequency becomes a test frequency higher than said dimming frequency from the dimming frequency based upon said dimming signal.

3. A dimming apparatus of a fluorescent lamp as claimed in claim 2 wherein:

when the detection voltage of said lamp voltage detecting circuit is higher than a preset threshold value voltage, said control unit sets a lower limit dimming value; and when the set dimming degree based on said dimming signal is smaller than said lower limit dimming value, while the control unit sets the output frequency of said high frequency power supply to a frequency higher than said dimming frequency, said control unit varies said output frequency from said test frequency to an upper limit frequency in response to said lower limit dimming value.

4. A dimming apparatus of a fluorescent lamp as claimed in claim 2 wherein:

in the case that a difference voltage is higher than, or equal to a preset threshold value voltage, said difference voltage being produced between a detection voltage by said lamp voltage detecting circuit when a dimming frequency is outputted and another detection voltage by said lamp voltage detecting circuit when a test frequency higher than said dimming frequency is outputted, said control unit sets a lower limit dimming value; and in the case that the set dimming degree based upon said dimming signal is smaller than said lower limit dimming value, said control unit sets the output frequency of said high frequency power supply to an upper limit frequency in response to said lower limit dimming value.

5. A dimming apparatus of a fluorescent lamp as claimed in claim 4 wherein:

in the case that said difference voltage is higher than, or equal to said preset threshold value voltage, said difference voltage being produced between said detection voltage by said lamp voltage detecting circuit when said dimming frequency is outputted and another detection voltage by said lamp voltage detecting circuit when said test frequency higher than said dimming frequency is outputted, said control unit controls the output frequency of the high frequency power supply to become said dimming frequency.

6. A dimming apparatus of a fluorescent lamp as claimed in claim 4 wherein:

in the case that said difference voltage is higher than, or equal to said preset threshold value voltage, said difference voltage being produced between said detection voltage by said lamp voltage detecting circuit when said dimming frequency is outputted and another detection voltage by said lamp voltage detecting circuit when said test frequency higher than said dimming frequency is outputted, said control unit controls the output frequency of said high frequency power supply to be returned to said dimming frequency after controlling the output frequency for a predetermined time period in such a manner that said output frequency becomes a current increase frequency lower than said dimming frequency.

7. A dimming apparatus of a fluorescent lamp as claimed in claim 1 wherein:

said control unit sets said lower limit dimming set value of said fluorescent lamp within a range from 5% to 60% with respect to a dimming degree when the rated power is entered to said fluorescent lamp in the normal temperature.

8. A dimming apparatus of a fluorescent lamp as claimed in claim 1 wherein:

said control unit varies the lower limit dimming set value in response to the detection voltage of said lamp voltage detecting circuit.

9. A dimming apparatus of a fluorescent lamp as claimed in claim 1 wherein:

said control unit sets a relationship between a time period T0 and a dimming frequency f1 to $T0 \geqq 3/f1$, in which a frequency is intermittently varied in said time period T0.

10. A dimming apparatus of a fluorescent lamp as claimed in claim 1 wherein:

said control unit sets time T0 during which a frequency is intermittently varied to $T0 \geqq 0.1$ ms.

11. A dimming apparatus of a fluorescent lamp as claimed in claim 1 wherein:

said control unit sets both time T0 during which a frequency is intermittently varied and time T2 during which a frequency higher than said dimming frequency is outputted to $T2 \leqq T0/2$.

* * * * *